US005814591A

United States Patent [19]

Mills et al.

[11] Patent Number: 5,814,591

[45] Date of Patent: Sep. 29, 1998

[54] HARD SURFACE CLEANER WITH ENHANCED SOIL REMOVAL

[75] Inventors: Scott C. Mills, Livermore; Jennifer C. Julian, Dublin, both of Calif.

[73] Assignee: The Clorox Company, Oakland, Calif.

[21] Appl. No.: 632,041

[22] Filed: Apr. 12, 1996

[51] Int. Cl.[6] ..... C11D 1/835; C11D 1/88

[52] U.S. Cl. ..... 510/238; 510/362; 510/423; 510/434; 510/469; 510/480; 510/493; 510/503; 510/504

[58] Field of Search ..... 510/238, 362, 510/421, 422, 423, 434, 480, 504, 503, 469, 493

[56] References Cited

U.S. PATENT DOCUMENTS

| | | | |
|---|---|---|---|
| H269 | 5/1987 | Malik | 422/37 |
| 4,029,607 | 6/1977 | Murtaugh | 252/545 |
| 4,158,644 | 6/1979 | Hamerel | 252/547 |
| 4,176,080 | 11/1979 | Wise et al. | 252/162 |
| 4,207,215 | 6/1980 | Bolan | 252/542 |
| 4,268,406 | 5/1981 | O'Brien et al. | 252/105 |
| 4,530,781 | 7/1985 | Gipp | 252/546 |
| 4,540,505 | 9/1985 | Frazier | 252/106 |
| 4,576,729 | 3/1986 | Paszek et al. | 252/106 |
| 4,595,527 | 6/1986 | Gipp | 252/546 |
| 4,637,899 | 1/1987 | Kennedy, jr. | 252/542 |
| 4,687,592 | 8/1987 | Collins | 252/99 |
| 4,734,259 | 3/1988 | Frenier | 422/16 |
| 4,749,516 | 6/1988 | Brusky | 252/546 |
| 4,798,679 | 1/1989 | Castro et al. | 252/174.15 |
| 4,844,744 | 7/1989 | Leiter | 134/40 |
| 4,944,892 | 7/1990 | Leathers et al. | 252/92 |
| 5,013,483 | 5/1991 | Frenier | 252/396 |
| 5,062,987 | 11/1991 | Turcotte | 252/156 |
| 5,071,582 | 12/1991 | Conville | 252/81 |
| 5,252,245 | 10/1993 | Garabedian, Jr. | 252/153 |
| 5,266,121 | 11/1993 | Cioletti | 134/3 |
| 5,328,561 | 7/1994 | Letize | 156/666 |
| 5,417,887 | 5/1995 | Skeele | 252/309 |
| 5,437,807 | 8/1995 | Garabedian, Jr. | 252/153 |
| 5,454,984 | 10/1995 | Graubart | 252/547 |
| 5,468,423 | 11/1995 | Garabedian, Jr. | 252/546 |
| 5,476,615 | 12/1995 | Hall | 252/547 |
| 5,522,942 | 6/1996 | Graubart et al. | 134/40 |
| 5,536,452 | 7/1996 | Black | 252/238 |
| 5,587,022 | 12/1996 | Black | 134/26 |

FOREIGN PATENT DOCUMENTS

| | | | |
|---|---|---|---|
| 715521 | 8/1965 | Canada . | |
| 2-180999 | 7/1990 | Japan | C11D 3/33 |
| 2075043 | 11/1981 | United Kingdom . | |

*Primary Examiner*—Paul Lieberman
*Assistant Examiner*—John R. Hardee
*Attorney, Agent, or Firm*—Joel J. Hayashida

[57] ABSTRACT

An aqueous hard surface cleaner with improved soil removal is provided and has, as components, the following:

(a) either a nonionic or amphoteric surfactant with optionally, a quaternary ammonium surfactant, the total amount of the surfactants being present in a cleaning effective amount;

(b) at least one water-soluble or dispersible organic solvent having a vapor pressure of at least 0.001 mm Hg at 25° C., present in a solubilizing—or dispersion—effective amount;

(c) Ammonium ethylenediamine-tetraacetate (ammonium EDTA) as a chelating agent, present in an amount effective to enhance soil removal in said cleaner; and (d) the remainder, water.

14 Claims, 2 Drawing Sheets

HARD SURFACE CLEANER WITH ENHANCED SOIL REMOVAL

BACKGROUND OF THE INVENTION

1. Field of the Invention

The invention relates to a hard surface cleaner especially effective on bathroom soils, such as soap scum.

2. Brief Statement of the Related Art

A number of hard surface cleaners have been specially formulated to target bathroom soils. These include products containing liquid hypochlorite for combating mildew and fungus; products with quaternary ammonium compounds as bacteriostats; and acidic cleaners, such as those containing phosphoric or other strong mineral acids.

These cleaners will typically include buffers, dyes, fragrances, and the like in order to provide performance and/or aesthetic enhancements.

Gipp, U.S. Pat. No. 4,595,527, discloses a laundry prespotter consisting essentially of at least 5% nonionic surfactants and chelating agents, including ammonium EDTA, but which is substantially solvent-free.

Murtaugh, U.S. Pat. No. 4,029,607, discloses the use of ammonium EDTA in a drain opener, while Bolan, U.S. Pat. No. 4,207,215, discloses the use of ammonium EDTA in a thixotropic gel for tile cleaning. Neither of these two references, however, discloses, teaches or suggests the presence of a solvent, nor discloses, teaches or suggests the formulation of a liquid, single phase bathroom cleaner with enhanced soil removal.

Graubart et al., U.S. Pat. No. 5,454,984, discloses a cleaning composition comprising quaternary ammonium compounds, tetrasodium EDTA, a mixture of surfactants, and a glycol ether. However, the reference fails to teach, disclose or suggest the use of ammonium EDTA as a chelating agent.

Garabedian et al., U.S. Pat. Nos. 5,252,245, 5,437,807 and 5,468,423, and Choy et al., U.S. Pat. No. 5,585,342 , all of common assignment herewith, disclose improved glass and surface cleaners which combine either amphoteric or nonionic surfactants with solvents and effective buffers to provide excellent streaking/filming characteristics on glass and other smooth, glossy surfaces. These disclosures are incorporated herein by reference thereto.

Co-pending application Ser. No. 08/807,187, filed Feb. 27, 1997, a continuation of Ser. No. 08/507,543, filed Jul. 26, 1995, now abandoned, of Zhou et al., entitled "Antimicrobial Hard Surface Cleaner," of common assignment, discloses and claims an antimicrobial hard surface cleaner which includes amine oxide, quaternary ammonium compound and tetrasodium EDTA, in which a critical amine oxide: EDTA ratio results in enhanced non-streaking and non-filming performance.

However, more of the art discloses, teaches or suggest the use of ammonium EDTA as an effective chelating agent which additionally surprisingly enhances the soil removing, especially soap scum-removing, ability of the liquid, one phase cleaners formulated therewith. Moreover, none of the art discloses, teaches or suggests the unexpected speed at which the inventive cleaners work.

SUMMARY OF THE INVENTION AND OBJECTS

The invention provides an aqueous, hard surface cleaner, said cleaner comprising:

an aqueous hard surface cleaner with improved soil, especially soap scum, removal comprising:

(a) either a nonionic or amphoteric surfactant with optionally, a quaternary ammonium surfactant, said surfactants being present in a cleaning—effective amount;

(b) at least one water-soluble or dispersible organic solvent having a vapor pressure of at least 0.001 mm Hg at 25° C., said at least one organic solvent present in a solubilizing—or dispersion—effective amount;

(c) Ammonium ethylenediamine - tetraacetate (ammonium EDTA) as a chelating agent, said ammonium EDTA present in an amount effective to enhance soil removal in said cleaner; and (d) the remainder, water.

The invention further comprises a method of cleaning soils, especially soap scum from hard surfaces by applying said inventive cleaner to said soap scum, and removing both from said surface.

It is therefore an object of this invention to improve soil, especially soap scum, removal from hard surfaces.

It is another object of this invention to markedly increase the speed in which such soils, especially soap scum, are removed from the hard surface cleaned.

It is also an object of this invention to provide a hard surface cleaner for bathroom soils, which include oily and particulate soils.

DETAILED DESCRIPTION OF THE INVENTION

Figure 1:
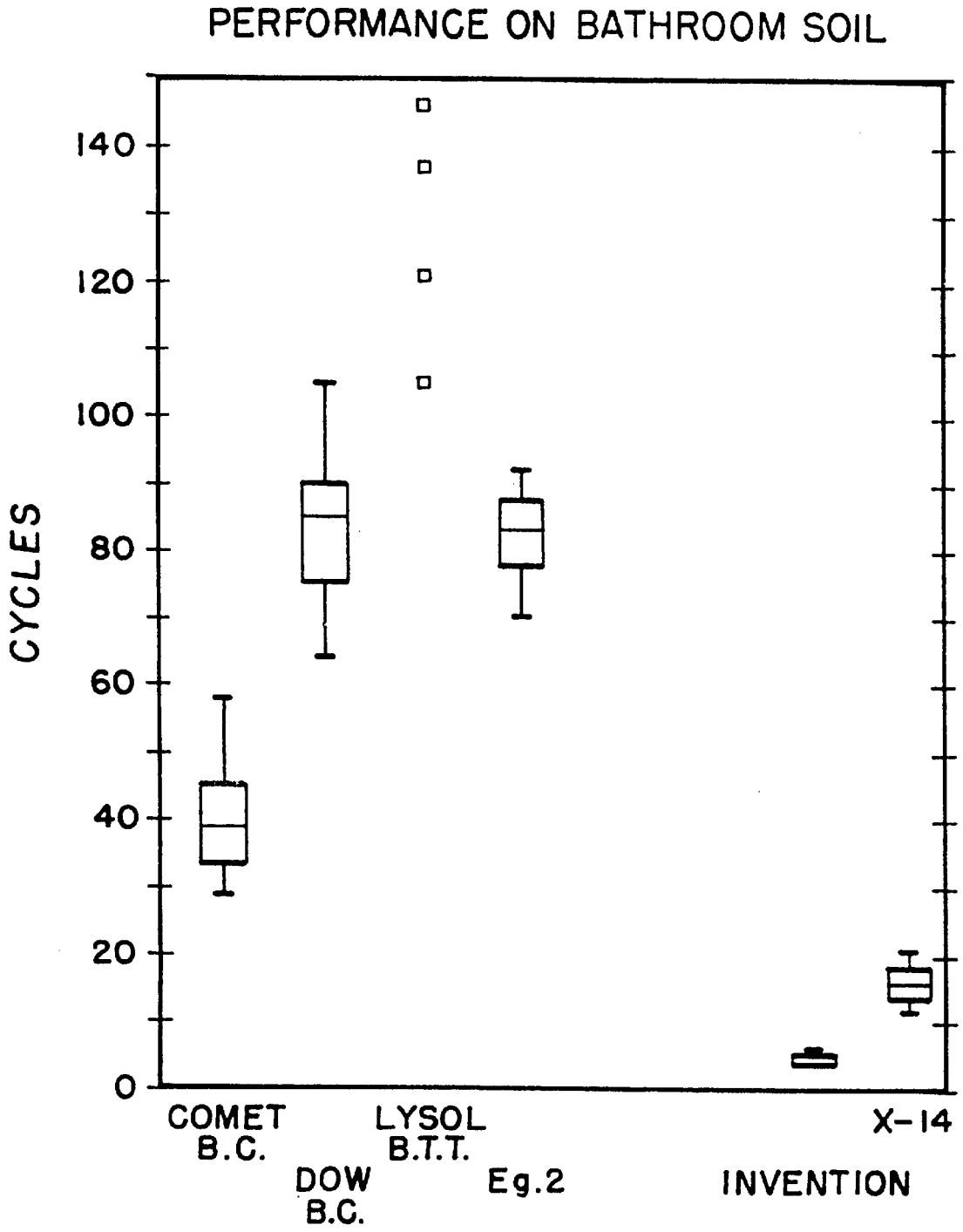
FIGS. 1–2 are graphical depictions of the soil removing performances of the inventive cleaner.

The invention provides an improved, all purpose cleaner especially adapted for the complete and speedy removal of soap scum and other bathroom soils from a hard surface. These types of cleaners are intended to clean hard surfaces by application of a metered discrete amount of the cleaner, typically by pump or trigger sprayer onto the surface to be cleaned or onto the workpiece—such as a soft cloth, mop or sponge—and then wiping the surface, thus removing the soil and the cleaner, with or without the need for rinsing with water. In the case of a concentrate, the concentrate is first diluted with water, or water/solvent mixture, then the diluted mixture is applied by workpiece or by simply pouring onto the surface to be cleaned. The typical bathroom surface is a shower stall, both the glass doors, as well as the vertical wall surfaces (typically made of tile, or composite materials). The cleaner is preferably a single phase, clear, isotropic solution, having a viscosity generally less than about 100 Centipoise ("cps") (unless as a concentrate, in which case, below about 100,000 cps). The cleaner itself has the following ingredients:

(a) a nonionic or amphoteric surfactant with optionally, a quaternary ammonium surfactant, said surfactants being present in a cleaning—effective amount;

(b) at least one water-soluble or dispersible organic solvent having a vapor pressure of at least 0.001 mm Hg at 25° C., said at least one organic solvent present in a solubilizing—or dispersion—effective amount;

(c) Ammonium ethylenediamine - tetraacetate (ammonium EDTA) as a chelating agent, said ammonium present in an amount effective to enhance soil, especially soap scum, removal in said cleaner; and (d) the remainder, water.

Additional adjuncts in small amounts such as buffers, fragrance, dye and the like can be included to provide desirable attributes of such adjuncts.

In the application, effective amounts are generally those amounts listed as the ranges or levels of ingredients in the descriptions which follow hereto. Unless otherwise stated, amounts listed in percentage ("%'s") are in weight percent (based on 100% active) of the composition.

1. Solvents

The solvent is a water soluble or dispersible organic solvent having a vapor pressure of at least 0.001 mm Hg at 25° C. It is preferably selected from $C_{1-6}$ alkanol, $C_{1-6}$ diols, $C_{3-24}$ alkylene glycol ethers, and mixtures thereof. The alkanol can be selected from methanol, ethanol, n-propanol, isopropanol, butanol, pentanol, hexanol, their various positional isomers, and mixtures of the foregoing. It may also be possible to utilize in addition to, or in place of, said alkanols, the diols such as methylene, ethylene, propylene and butylene glycols, and mixtures thereof.

It is preferred to use an alkylene glycol ether solvent in this invention. The alkylene glycol ether solvents can include ethylene glycol monobutyl ether, ethylene glycol monopropyl ether, propylene glycol n-propyl ether, propylene glycol monobutyl ether, dipropylene glycol methyl ether, and mixtures thereof Preferred glycol ethers are ethylene glycol monobutyl ether, also known as butoxyethanol, sold as butyl Cellosolve by Union Carbide, and also sold by Dow Chemical Co., 2-(2-butoxyethoxy) ethanol, sold as butyl Carbitol, also by Union Carbide, and propylene glycol n-propyl ether, available from a variety of sources. Another preferred alkylene glycol ether is propylene glycol, t-butyl ether, which is commercially sold as Arcosolve PTB, by Arco Chemical Co. The n-butyl ether of propylene glycol is also preferred. Other suppliers of preferred solvents include Union Carbide. If mixtures of solvents are used, the amounts and ratios of such solvents used are important to determine the optimum cleaning and streak/film performances of the inventive cleaner. It is preferred to limit the total amount of solvent to no more than 50%, more preferably no more than 25%, and most preferably, no more than 15%, of the cleaner. A preferred range is about 1–15%. These amounts of solvents are generally referred to as dispersion-effective or solubilizing effective amounts, since the other components, such as surfactants, are materials which are assisted into solution by the solvents. The solvents are also important as cleaning materials on their own, helping to loosen and solubilize greasy soils for easy removal from the surface cleaned.

2. Surfactants

The surfactant is a nonionic or amphoteric surfactant, or mixtures thereof Optionally, a quaternary ammonium surfactant can be added.

a. Nonionic and Amphoteric Surfactants

The nonionic surfactants are selected from alkoxylated alcohols, alkoxylated phenol ethers, and other surfactants often referred to as semi-polar nonionics, such as the trialkyl amine oxides. The alkoxylated phenol ethers include octyl- and nonylphenol ethers, with varying degrees of alkoxylation., such as 1–10 moles of ethylene oxide per mole of phenol. The alkyl group can vary from $C_{6-16}$, although octyl- and nonyl chain lengths are readily available. Various suitable products available from Rohm and Haas under the trademark Triton, such as Triton N-57, N-101, N-111, and from Mazer Chemicals under the trademark Macol, from GAF Corporation under the trademark Igepal, from Texaco Chemical Company under the trademark Surfonic. The alkoxylated alcohols include ethoxylated, and ethoxylated and propoxylated $C_{6-16}$ alcohols, with about 2–10 moles of ethylene oxide, or 1–10 and 1–10 moles of ethylene and propylene oxide per mole of alcohol, respectively. Exemplary surfactants are available from Shell Chemical under the trademarks Neodol and Alfonic. The semi-polar amine oxides are especially preferred, although, for the invention, a mixture of nonionic and amine oxide surfactants can be used. The amine oxides have the general configuration:

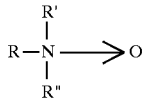

wherein R is $C_{6-24}$ alkyl, and R' and R" are both $C_{1-4}$ alkyl, or $C_{1-4}$ hydroxyalkyl, although R' and R" do not have to be equal. These amine oxides can also be ethoxylated or propoxylated. The preferred amine oxide is lauryl amine oxide. The commercial sources for such amine oxides are Barlox 10, 12, 14 and 16 from Lonza Chemical Company, Varox by Witco and Ammonyx by Stepan Co.

A further preferred semi-polar nonionic surfactant is alkylamidoalkylenedialkylamine oxide. Its structure is shown below:

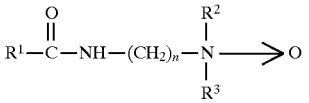

wherein $R^1$ is $C_{5-20}$ alkyl, $R^2$ and $R^3$ are $C_{1-4}$ alkyl,

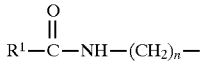

or $—(CH_2)_p—OH$, although $R^2$ and $R^3$ do not have to be equal or the same substituent, and n is 1–5, preferably 3, and p is 1–6, preferably 2–3. Additionally, the surfactant could be ethoxylated (1–10 moles of EO/mole) or propoxylated (1–10 moles of PO/mole).

This surfactant is available from various sources, including from Lonza Chemical Company, as a cocoamidopropyldimethyl amine oxide, sold under the brand name Barlox C.

Additionally semi-polar surfactants include phosphine oxides and sulfoxides.

The amphoteric surfactant is typically an alkylbetaine or a sulfobetaine. One group of preferred amphoterics are alkylamidoalkyldialkylbetaines. These have the structure:

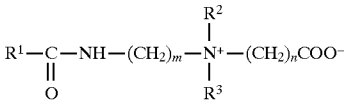

wherein $R^1$ is $C_{6-20}$ alkyl, $R^2$ and $R^3$ are both $C_{1-4}$ alkyl, although $R^2$ and $R^3$ do not have to be equal, and m can be 1–5, preferably 3, and n can be 1–5, preferably 1. These alkylbetaines can also be ethoxylated or propoxylated. The preferred alkylbetaine is a cocoamidopropyldimethyl betaine called Lonzaine CO, available from Lonza Chemical Co. Other vendors are Henkel KGaA, which provides Velvetex AB, and Witco Chemical Co., which offers Rewoteric AMB-15, both of which products are cocobetaines.

The amounts of surfactants present are to be somewhat minimized, for purposes of cost-savings and to generally restrict the dissolved actives which could contribute to leaving behind residues when the cleaner is applied to a surface. However, the amounts added are generally about 0.001–10%, more preferably 0.002–3.00% surfactant. These are generally considered to be cleaning-effective amounts. On the other hand, if a dilutable concentrate is desired, the upper level of surfactant can be as high as 25%, more preferably around 15%. If an optional quaternary ammonium surfactant is present, the ratio of nonionic or amphoteric surfactant to quaternary ammonium surfactant is about 100:1 to 1:5, more preferably about 50:1 to 1:2.

b. Quaternary Ammonium Surfactant

The invention further optionally includes a cationic surfactant, specifically, a quaternary ammonium surfactant. These types of surfactants are typically used in bathroom cleaners because they are generally considered "broad spectrum" antimicrobial compounds, having efficacy against both gram positive (e.g., *Staphylococcus sp.*) and gram negative (e.g., *Escherischia coli*) microorganisms. Thus, the quaternary ammonium surfactant, or compounds, are incorporated for bacteriostatic/disinfectant purposes and should be present in amounts effective for such purposes.

The quaternary ammonium compounds are selected from mono-long-chain, tri-short-chain, tetraalkyl ammonium compounds, di-long-chain, di-short-chain tetraalkyl ammonium compounds, trialkyl, mono-benzyl ammonium compounds, and mixtures thereof By "long" chain is meant about $C_{6-30}$ alkyl. By "short" chain is meant $C_{1-5}$ alkyl, preferably $C_{1-3}$ . Preferred materials include Stepan series, such as BTC2125 series; Barquat and Bardac series, both from Lonza Chemical. Typical amounts of the quaternary ammonium compound range from preferably about 0–5%, more preferably about 0.001–2%.

3. Ammonium EDTA

The tetraammonium ethylene diamine tetraacetate (referred to as "ammonium EDTA") is a critical part of the invention. Its use, in place of the standard chelating agent, tetrasodium EDTA, results in not only a surprisingly complete removal of various soils, including bathroom soap scum soils, but an unexpectedly rapid removal as well. The fact that the ammonium salt of EDTA is so effective versus the tetrasodium salt was quite unawaited since, in other literature, the ammonium salt has not been demonstrated to be a superior performer as compared to the tetrasodium salt.

The amount of ammonium EDTA added should be in the range of 0.01–25%, more preferably 0.01–10%, by weight of the cleaner.

4. Water and Miscellaneous

Since the cleaner is an aqueous cleaner with relatively low levels of actives, the principal ingredient is water, which should be present at a level of at least about 50%, more preferably at least about 80%, and most preferably, at least about 90%. Deionized water is preferred.

Small amounts of adjuncts can be added for improving cleaning performance or aesthetic qualities of the cleaner. For example, buffers could be added to maintain constant pH (which for the invention is between about 7–12, more preferably between about 8–11). These buffers include NaOH, KOK, $Na_2CO_3$, $KCO_3$, as alkaline buffers, and phosphoric, hydrochloric, sulfuric acids as acidic buffers, and others. Builders, such as phosphates, silicates, and again, carbonates, may be desirable. Further solubilizing materials, such as hydrotropes, e.g.s., cumene, toluene and xylene sulfonates, may also be desirable. Adjuncts for cleaning include additional surfactants, such as those described in *Kirk-Othmer, Encyclopedia of Chemical Technology,* 3rd Ed., Volume 22, pp. 332–432 (Marcel-Dekker, 1983), and *McCutcheon's Soaps and Detergents* (N. Amer. 1984), which are incorporated herein by reference. Aesthetic adjuncts include fragrances, such as those available from Givaudan, IFF, Quest, Sozio, Firmenich, Dragoco and others, and dyes and pigments which can be solubilized or suspended in the formulation, such as diaminoanthraquinones. Water-insoluble solvents may sometimes be desirable as added grease or oily soil cutting agents. These types of solvents include tertiary alcohols, hydrocarbons (alkanes), pine-oil, d-limonene and other terpenes and terpene derivatives, and benzyl alcohols. Thickeners, such as calcium carbonate, sodium bicarbonate, aluminum oxide, and polymers, such as polyacrylate, starch, xanthan gum, alginates, guar gum, cellulose, and the like, may be desired additives. The use of some of these thickeners ($CaCO_3$ or $NaHCO_3$) is to be distinguished from their potential use as builders, generally by particle size or amount used. Anti-foaming agents, or foam controlling agents, may be also desirable, such as silicone defoamers. The amounts of these cleaning and aesthetic adjuncts should be in the range of 0–10%, more preferably 0–2%.

In the following Experimental section, the surprising performance benefits of the various aspects of the inventive cleaner are demonstrated.

EXPERIMENTAL

In the following experiments, the inventive cleaner was compared against comparative cleaners and against commercial bathroom cleaners.

A base formulation for the invention set forth in Example 1, a similar comparison 5 formulation, which, however, contains as a chelating agent tetrasodium EDTA, is set forth as Example 2.

| Ingredients | Example 1 (Invention) | Example 2 (Comparison) |
|---|---|---|
| $K_2CO_3$[1] | 0.1 | 0.1 |
| $NH_4)_4$EDTA | 5.45 | — |
| $Na_4$EDTA | — | 5.45 |
| Solvent[2] | 4.5 | 4.5 |
| Quaternary Ammonium Compound[3] | 0.27 | 0.27 |
| Nonionic Surfactant[4] | 2.25 | 2.25 |
| Fragrance | 0.25 | 0.25 |
| Water | balance to 100% | balance to 100% |

[1]Buffer
[2]Butyl carbitol, from Union Carbide
[3]Di-long-chain, di-short-chain tetraalkyl ammonium chloride, BTC 2125 from Stepan Co.
[4]Octylphenol ethoxylate, about 10 moles of ethylene oxide ("EO") per mole of phenol Triton X-100, from Rohm and Haas.

EXAMPLE 3

Preparation of Bathroom Soil

A laboratory soil (CSMA No. D-5343-93) combining sebum, dirt and soap scum precipitate was prepared. This is a mixture of potting soil, synthetic sebum (mixture of saturated and unsaturated long chain fatty acids, paraffin, cholesterol and sperm wax, among other materials) and stearate premix (calcium stearate, magnesium stearate and iron stearate). The laboratory soil was applied to pre-baked white tiles and dried in an oven at 75°–80° C. for one hour.

EXAMPLE 4

Preparation of Simulated Aged Soap Scum

This laboratory soil (modified from Industry accepted standards) simulates aged soap scum and was prepared by making a calcium stearate suspension (ethanol, calcium stearate and water). This soap scum soil was then sprayed onto black ceramic tiles which were baked at 165°–170° C. for one hour, then cooled.

EXAMPLE 5

Bathroom Soil Removal

The invention of Example 1 and the Comparison Example 2 were tested for complete soil removal of bathroom soil from tiles (as prepared in Example 3). So, in this test, lower scores (cycles to remove) are preferred. The tiles were loaded onto a Gardner Abrasion Tester equipped with sponges. The test was run generally for at least eight replicates. The results demonstrate that Example 1's formula took less than 10 cycles of the Gardner device to remove soil from the tile, while Comparison Example 2's formula took around 80 cycles. This dramatic difference is graphically depicted in FIG. 1. Similarly, the commercial products Comet Bathroom Cleaner (Procter & Gamble), Dow Bathroom Cleaner (Dow Brands), Lysol Basin Tub & Tile Cleaner (Reckitt & Colman), and X-14 Soap Scum Remover (Block Drug) did not perform as well as the Invention.

EXAMPLE 6

One Coat Soap Scum—Drop Tests

The One Coat Soap Scum—Drop Tests involve panels, prepared as in Example 4, to which a very small, discrete amount of cleaner is dropped, by pipette, and then visually graded by a panel of expert graders on a 1 to 10 scale, where 1 indicates no soil removal, while 10 indicates complete removal. The observed results are averaged and subject to error analysis using Fisher's least significant difference ("LSD"), with a confidence level of 95%.

The Drop Tests were conducted at 2 minutes, 3 minutes and 4 minutes, and are depicted in Table I below.

TABLE I

One Coat Soap Scum - Drop Tests

| Eg.1 Invention | Eg. 2 Comparison | Grade @ x mins |
|---|---|---|
| 9 | 3 | 2 minutes |
| 10 | 4 | 3 minutes |
| 10 | 10 | 4 minutes |

This test is especially noteworthy for demonstrating the speed with which the inventive cleaner of Example 1 performs versus the comparison Example 2. It is observed that, at 2 minutes, the soap scum removal for the inventive cleaner is about 9, whereas the comparison example 2 is only at about 3. At 3 minutes, the inventive cleaner is at about 10, while the comparison example has incrementally risen to about 4. Finally, at four minutes, the comparison example has "caught up," but these examples are without benefit of mechanical action by either a testing device, like the Gardner device, or by human reciprocation of a sponge or other wicking or doctoring device.

In the next example, the effect of added mechanical action was studied.

EXAMPLE 7

One Coat Soap Scum—Scrub Test

In this example, a Gardner device was utilized. A single soap scum coating on tiles (as in Example 4) was used. 15 grams of cleaner (Example 1 and comparison Example 2) were applied to a previously wetted sponge on the Gardner device. The Gardner machine was set for 80 cycles, with five replicates of each cleaner. Thereafter, the tiles were rinsed with a tight stream of deionized water. A panel of 10 expert graders then judged each tile on a scale of 1 to 10, with 1 indicating no cleaning and 10 indicated total cleaning. The results are depicted in Table 2 below. Again, unexpectedly, the invention demonstrates a cleaning score of about 9, while the comparison Example 2 has a score of about 5. These scores are again within the 95% confidence level.

TABLE II

One Coat Soap Scum - Scrub Test

| Eg. 1 Invention | Eg. 2 Comparison | No. of Cycles |
|---|---|---|
| 9 | 5 | 80 |

EXAMPLE 8

Bathroom Soil % Removal

In this example, a screening study of both the inventive cleaner, which was varied by substituting in 5 different alternative surfactants (at the same levels as in Example 1) was compared against not only the Comparison Example 2, but as against that Comparison Example with a different surfactant, and as against four different commercially available bathroom cleaners. The commercial cleaners are: Lysol (Foam) Basin Tub and Tile Cleaner, Lysol Basin Tub and Tile Cleaner—both from Reckitt and Colman—, Dow (Foam) Bathroom Cleaner and Dow Bathroom Cleaner, the latter two from Dow Brands. None of the four commercial cleaners contain ammonium EDTA.

In this study, tiles are soiled as in Example 3, and then loaded onto a proprietary and automated reader/scrubber. The reader/scrubber measures % soil removal by calibrating with a clean tile, which would establish 100% clean, versus a completely soiled tile, which would establish a zero % clean. Each soiled tile cleaned by the scrubber is measured during the cleaning by the reader to establish the differences in shading between the initially completely soiled panel and the completely cleaned one. The data thus gathered is plotted on a graph in which the y axis is % soil removed, the x axis is the number of cycles.

In this test, Inventive Examples 9–13 varied in types and amounts of surfactants, as well as in ammonium EDTA levels. Further, Comparison Example 2 was tested, but it was also modified as Comparison Example 2A, in which a different surfactant was used. These differences are set forth in the Table III below:

TABLE III

Variations in Inventive and Comparison Formulations

| | Surfactant | Amount | $NH_2EDTA$ Level |
|---|---|---|---|
| Example | | | |
| 9 | Barlox 12 | 3.5% | 6.5% |
| 10 | Alfonic 610-50 | 0.11% | 6.5% |
| 11 | Alfonic 610-50 | 0.11% | 2.5% |
| 12 | Barlox 12 | 1.8% | 4.5% |
| 13 | Barlox 12 | 0.1% | 6.5% |
| Comparison | | | |
| 2A | Surfonic L12-6 | 2.25% | 5.45% |

Figure 2:
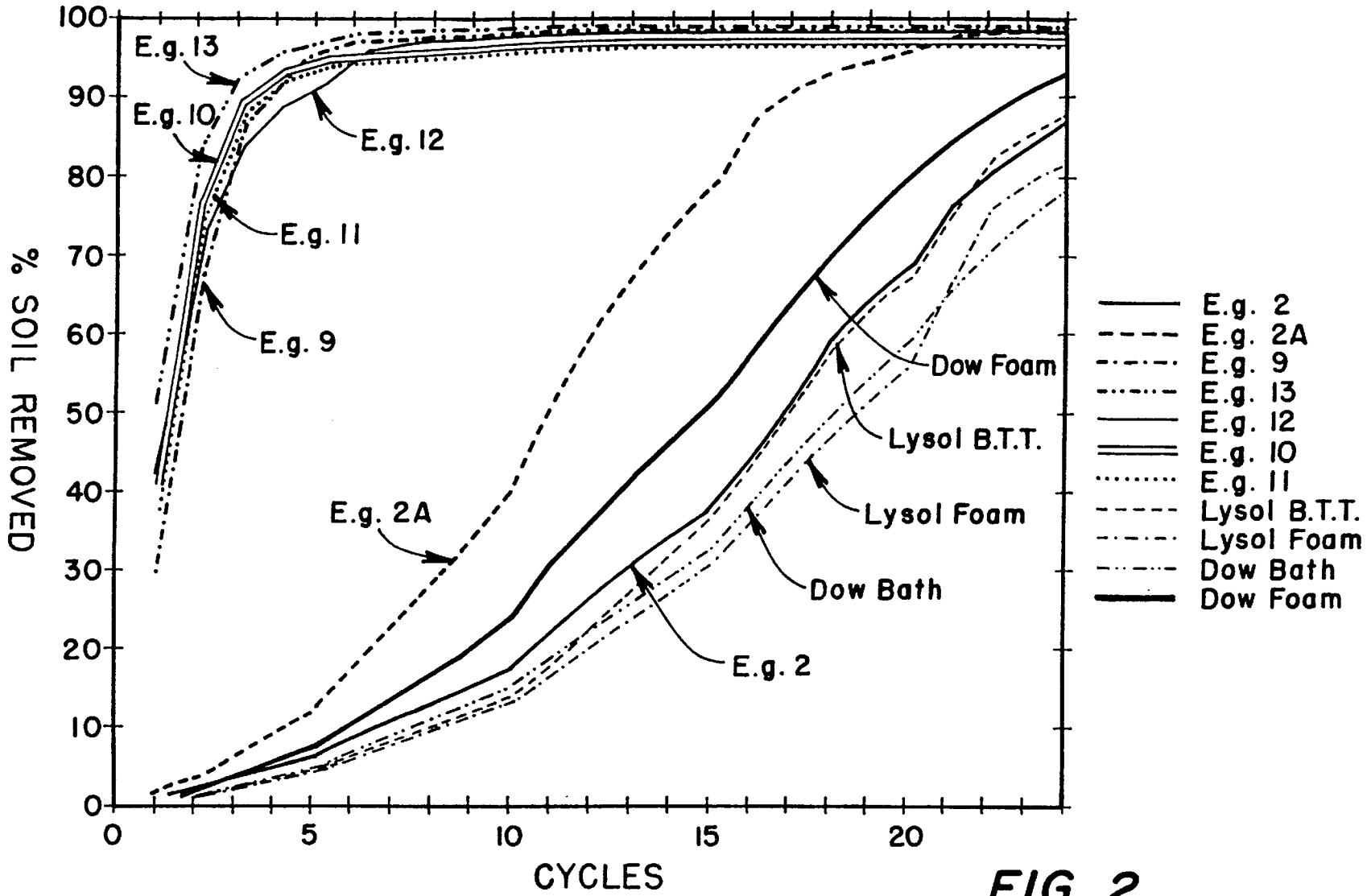

As can be seen from the results, which are graphically depicted in FIG. 2, the cleaners containing ammonium EDTA clearly and unambiguously outperform the comparison (Examples 2 and 2A) and commercial cleaners. (Because the program which plots the graph has limited ways of showing lines, many of the line formats are repeated for different Examples in FIG. 2.)

In the next example, an additional inventive formulation is set forth.

EXAMPLE 14

Additional Inventive Formulation

| Ingredients | Wt. % Active |
|---|---|
| $(NH_4)_4EDTA$ | 2.7–3.3 |
| Solvent[1] | 4.5 |
| Quaternary Ammonium Compound[2] | 0.28 |
| Semi-Polar Nonionic Surfactant[3] | 1.00 |
| Fragrance | 0.3 |
| Water | balance to 100% |

[1]Butyl cellosolve, Union Carbide
[2]Di-long chain, di-short chain, tetraalkyl ammonium chloride, Stepan Co., BTC 2125.
[3]C12, dimethylamine oxide, Barlox 12, from Lonza.

The above formulation in Example 14 also proved to be surprisingly effective versus a variety of soils.

In the next example the level of the surfactant present, and such effect on performance, were addressed. Once again, the bathroom soil of Example 3 was used, and the Drop Tests (as in Example 6's protocol, but using much shorter observation periods for the panelists) performed for 30, 45 and 60 seconds. Comparisons were made against the commercial products X-14, Lysol Basin Tub and Tile Cleaner, Dow Bathroom Cleaner, and Comparison Example 2 and a modification thereof. The inventive formulations were patterned from Example 14 above, but also varied in level of surfactant, namely the amine oxide, which is a lauryldimethylamine oxide. The differing levels of surfactant are from 0.75, 0.90, 1.05, and 1.20%, with 1.45% representing the norm. These are set forth as Examples 15–19. The inventive formulation was also modified to contain a buffer, $K_2CO_3$ (0.1%) This is Example 20. Comparison Example 2 was varied by, in one case, the substitution of the $Na_4EDTA$ with $Na_2EDTA$ at 3.0% (Comparison Example 2B). The results are tabulated in Table IV.

TABLE IV

| Bathroom Soil - Drop Tests | | | | | |
|---|---|---|---|---|---|
| Eg. 15 | Eg. 16 | Eg. 17 | Eg. 18 | Eg. 19 | Grade @ × secs. |
| 10 | 10 | 10 | 10 | 10 | 30 seconds |
| 10 | 10 | 10 | 10 | 10 | 45 seconds |
| 10 | 10 | 10 | 10 | 10 | 60 seconds |
| Eg. 20 | | | | | Grade @ × secs. |
| 10 | | | | | 30 seconds |
| 10 | | | | | 45 seconds |
| 10 | | | | | 60 seconds |
| X-14 SSR | Lysol | Dow | Eg. 2 | Eg. 2B | Grade @ × secs. |
| 5 | 1 | 1 | 1 | 1 | 30 seconds |
| 7 | 1 | 1 | 1 | 1 | 45 seconds |
| 10 | 1 | 1 | 1 | 2 | 60 seconds |

The above examples show conclusively that the inventive formulations containing ammonium EDTA consistently outperform comparison examples (with $Na_4EDTA$ or $NA_2EDTA$) and commercial cleaners, especially in rapidly removing soils starting with initial contact.

The foregoing examples are solely meant to illustrate the invention and do not limit the scope or equivalents thereof The invention is further exemplified by the claims which follow hereinbelow.

We claim:

1. An aqueous hard surface cleaner with improved soil removal comprising:

(a) either (i) a combination of a nonionic surfactant and a quaternary ammonium surfactant or (ii) an amphoteric surfactant, the total amount of said surfactant being present from about 0.001–10%, wherein said nonionic surfactant is selected from the group consisting of an alkoxylated alkylphenol ether, an alkoxylated alcohol, or a semi-polar nonionic surfactant which itself is selected from the group consisting of mono-long-chain alkyl, di-short-chain trialkyl amine oxides, alkylamidodialkyl amine oxides, phosphine oxides and sulfoxides;

(b) no more than 50% of at least one water-soluble or dispersible organic solvent having a vapor pressure of at least 0.001 mm Hg at 25° C.;

(c) 0.01–25% of tetraammonium ethylenediamine - tetraacetate (tetraammonium EDTA) as a chelating agent; and (d) the remainder, water.

2. The cleaner of claim 1 which comprises a single phase, isotropic solution.

3. The cleaner of claim 1 wherein said nonionic surfactant of (a) is a mono-long-chain, di-short-chain trialkyl amine oxide.

4. The cleaner of claim 1 wherein said nonionic surfactant is an ethoxylated alkylphenol ether selected from the group consisting of ethoxylated octylphenol ethers, ethoxylated nonylphenol ethers, and mixtures thereof.

5. The cleaner of claim 4 wherein said nonionic surfactant is an ethoxylated octylphenol, ethoxylated with 1–10 moles of ethylene oxide.

6. The cleaner of claim 1 wherein (a) further comprises a quaternary ammonium surfactant selected from the group consisting of mono-long-chain, tri-short-chain, tetraalkyl ammonium compounds, di-long-chain, di-short-chain tetraalkyl ammonium compounds, trialkyl, mono-benzyl ammonium compounds, and mixtures thereof.

7. The cleaner of claim 6 wherein said quaternary ammonium surfactant is a di-long-chain, di-short-chain, tetraalkyl ammonium halide.

8. The cleaner of claim 1 wherein said organic solvent of (b) is selected from the group consisting of alkanols, diols, glycol ethers, and mixtures thereof.

9. The cleaner of claim 8 wherein said organic solvent is a $C_{3-24}$ glycol ether.

10. The cleaner of claim 1 further comprising (e) at least one adjunct selected from the group consisting of builders, buffers, fragrances, thickeners, dyes, pigments, foaming stabilizers, water-insoluble organic solvents, and hydrotropes.

11. A method for removing a soil from a hard surface, said method comprising applying to said soil a hard surface cleaner which comprises:

(a) either (i) a combination of a nonionic surfactant and a quaternary ammonium surfactant or (ii) an amphoteric surfactant, the total amount of said surfactant being present from about 0.001–10%. wherein said nonionic surfactant is selected from the group consisting of an alkoxylated alkylphenol ether. an alkoxylated alcohol, or a semi-polar nonionic surfactant which itself is selected from the group consisting of mono-long-chain alkyl, di-short-chain trialkyl amine oxides. alkylamidodialkyl amine oxides. phosphine oxides and sulfoxides;

(b) no more than 50% of at least one water-soluble or dispersible organic solvent having a vapor pressure of at least 0.001 mm Hg at 25° C., said at least one organic solvent present in a solubilizing or dispersion—effective amount;

(c) 0.01–25% of tetraamnmonium ethylenediamine - tetraacetate (tetraammonium EDTA) as a chelating agent and (d) the remainder, water.

12. The method of claim 11 further comprising removing said soil and said cleaner from said surface.

13. A concentrate for an aqueous hard surface cleaner having improved soil removal comprising:

(a) either (i) a combination of a nonionic surfactant and a quaternary ammonium surfactant or (ii) an amphoteric surfactant, the total amount of said surfactant being present up to about 25% of said concentrate, wherein said nonionic surfactant is selected from the group consisting of an alkoxylated alkylphenol ether, an alkoxylated alcohol, or a semi-polar nonionic surfactant which itself is selected from the group consisting of mono-long-chain alkyl, di-short-chain trialkyl amine oxides, alkylamidodialkyl amine oxides, phosphine oxides and sulfoxides;

(b) no more than 50% of at least one water-soluble or dispersible organic solvent having a vapor pressure of at least 0.001 mm Hg at 25° C., said at least one organic solvent present in a solubilizing—or dispersion—effective amount;

(c) 0.01–25% of tetraammonium ethylenediamine - tetraacetate (tetraammonium EDTA) as a chelating agent; and (d) the remainder, water.

14. A method for the rapid removal of a soil from a hard surface comprising contacting the soil with a hard surface cleaner which comprises:

(a) either (i) a combination of a nonionic surfactant and a quaternary ammonium surfactant or (ii) an amphoteric surfactant, the total amount of said surfactant being present from about 0.001–10%, wherein said nonionic surfactant is selected from the group consisting of an alkoxylated alkylphenol ether, an alkoxylated alcohol, or a semi-polar nonionic surfactant which itself is selected from the group consisting of mono-long-chain alkyl, di-short-chain trialkyl amine oxides, alkylamidodialkyl amine oxides, phosphine oxides and sulfoxides;

(b) no more than 50% of at least one water-soluble or dispersible organic solvent having a vapor pressure of at least 0.001 mm Hg at 25° C, said at least one organic solvent present in a solubilizing or dispersion—effective amount;

(c) 0.01–25% of tetraammonium ethylenediamine - tetraacetate (tetraammonium EDTA) as a chelating agent; and (d) the remainder, water.

* * * * *